US005796320A

United States Patent [19]

Hattori et al.

[11] Patent Number: 5,796,320

[45] Date of Patent: Aug. 18, 1998

[54] DIELECTRIC RESONATOR

[75] Inventors: Jun Hattori, Takatsuki; Toru Kurisu, Kyoto; Shin Abe, Muko, all of Japan

[73] Assignee: Murata Manufacturing Co., Ltd., Japan

[21] Appl. No.: 796,254

[22] Filed: Feb. 6, 1997

[30] Foreign Application Priority Data

Feb. 7, 1996 [JP] Japan ..... 8-021394

[51] Int. Cl.[6] ..... H01P 7/10

[52] U.S. Cl. ..... 333/219.1; 333/235

[58] Field of Search ..... 333/202, 219, 333/219.1, 235

[56] References Cited

U.S. PATENT DOCUMENTS

| | | | |
|---|---|---|---|
| 4,642,591 | 2/1987 | Kobayashi | 333/227 |
| 5,638,037 | 6/1997 | Kurisu et al. | 333/219.1 |
| 5,642,085 | 6/1997 | Abe et al. | 333/219.1 |

FOREIGN PATENT DOCUMENTS

| | | | |
|---|---|---|---|
| 760534 | 3/1997 | European Pat. Off. . | |
| 3-292006 | 12/1991 | Japan | 333/219.1 |
| 7-245509 | 9/1995 | Japan | 333/219.1 |
| 8-288717 | 11/1996 | Japan . | |

OTHER PUBLICATIONS

*Patent Abstracts Of Japan*, vol. 17, No. 115 (E-1330), Mar. 10, 1993 & JP 04 296104 A, Oct. 28, 1992.

Y. Ishikawa, et al., "800 MHz High Power Duplexer Using TM Dual Mode Dielectric Resonators", *International Microwave Symposium Digest*, vol. 3, Jun. 1992.

*Primary Examiner*—Seungsook Ham

*Attorney, Agent, or Firm*—Ostrolenk, Faber, Gerb & Soffen, LLP

[57] ABSTRACT

A dielectric resonator includes a cylindrical hole formed in the intersection of two resonator elements forming a TM dual-mode dielectric resonator element. The hole extends in a direction across the thickness of the TM dual-mode dielectric resonator element. Furthermore, a quadrangular pyramid-shaped hole having a closed end is formed in each connecting part between each resonator element and a cavity wall so manner that each hole extends from the outer surface of the cavity wall toward the inner portion of each resonator element, wherein the inner wall of each hole is covered with a conductor electrically connected to a cavity conductor. The shapes of the above holes are determined so that the TM dual-mode dielectric resonator element has the same resonance frequency for both TM 110 and TM 111-modes. The above arrangement makes it possible to provide a low-cost high-performance dielectric resonator having characteristics similar to those of a three-mode dielectric resonator, which can be produced in a small overall size.

45 Claims, 5 Drawing Sheets

DIELECTRIC RESONATOR

BACKGROUND OF THE INVENTION

1. Field of the Invention

The present invention relates to a dielectric resonator comprising a TM dual-mode dielectric resonator element disposed in a cavity.

2. Description of the Related Art

FIG. 6 illustrates the structure of a conventional TM dual-mode dielectric resonator. In this and other figures, areas filled with dots represent those portions on which a conductor is formed.

The dielectric resonator shown in FIG. 6 comprises a TM dual-mode dielectric resonator element 2 disposed in an integral fashion in a cavity 1 serving as a waveguide. The dielectric resonator element 2 is made up of dielectric ceramic in such a manner that two rectangular resonator elements 2*a* and 2*b* each exhibiting resonance in a TM mode are integrated into one piece in a cross shape whereby the two resonator elements 2*a* and 2*b* are perpendicular to each other. The cavity 1 is formed with a rectangular-shaped frame of dielectric ceramic produced in an integral fashion together with the dielectric resonator element 2 by molding wherein each open side of the frame is closed with a side plate (not shown). The whole outer surface of cavity 1 is coated with a cavity conductor 3 such as Ag.

Each side plate is made up of a dielectric ceramic plate whose surface is covered with a conductor or made up of a conductive metal plate. Alternatively, each side plate may also be realized by means of utilizing a part of a metal case in which the dielectric resonator is disposed.

The integration of two resonator elements 2*a* and 2*b* into one piece makes it possible to produce a dielectric resonator in a reduced size, in which the resonator elements 2*a* and 2*b* are formed so that the TM 110-mode resonance frequencies of the respective resonator elements 2*a* and 2*b* are substantially equal and thus the dielectric resonator serves as a TM 110 dual mode dielectric resonator. That is, this dielectric resonator acts as a two-stage dielectric resonator composed of two resonator elements. This type of dielectric resonator is used, for example, as a dielectric filter in a communication device.

The above TM dual-mode dielectric resonator, however, is limited to a two-stage operation and it is impossible to achieve higher performance.

It is also known in the art to realize a three-stage dielectric resonator with the same size as that of the two-stage dielectric resonator by combining three resonator elements having substantially equal resonance frequency in TM 110-mode into one piece in such a manner that the resonator elements are perpendicular to each other thereby forming a TM three-mode dielectric resonator. However, such a TM three-mode dielectric resonator has a complicated structure and therefore is difficult to produce, which results in extremely high cost.

SUMMARY OF THE INVENTION

It is an object of the present invention to provide a high-performance low-cost dielectric resonator having characteristics similar to those of a three-mode resonator, which can be realized in a similar size without having to increase the size.

The above and other objects are achieved by the present invention as described below. According to a first aspect of the present invention, there is provided a dielectric resonator including two dielectric resonator elements perpendicular to each other and disposed in an integral fashion in a cavity so as to form a TM dual-mode dielectric resonator element, the dielectric resonator having a hole formed in the TM dual-mode dielectric resonator element, the hole extending from the outer surface of the cavity wall toward the inner portion of the TM dual-mode dielectric resonator element along its axis, the inner wall of the hole being covered with a conductor electrically connected to a cavity conductor, the hole being formed so that the TM 110-mode resonance frequency of the TM dual-mode dielectric resonator element is substantially equal to the TM 111-mode resonance frequency.

According to a second aspect of the present invention, there is provided a dielectric resonator including two dielectric resonator elements perpendicular to each other and disposed in an integral fashion in a cavity so as to form a TM dual-mode dielectric resonator element, the dielectric resonator having a hole formed in the intersection of the two dielectric resonator elements of the TM dual-mode dielectric resonator element, the hole being formed so that the TM 110-mode resonance frequency of the TM dual-mode dielectric resonator element is substantially equal to the TM 111-mode resonance frequency.

According to a third aspect of the present invention, there is provided a dielectric resonator including two dielectric resonator elements perpendicular to each other and disposed in an integral fashion in a cavity so as to form a TM dual-mode dielectric resonator element, the dielectric resonator having a first hole formed in the TM dual-mode dielectric resonator element, the first hole extending from the outer surface of the cavity wall toward the inner portion of the TM dual-mode dielectric resonator element along its axis, the inner wall of the first hole being covered with a conductor electrically connected to a cavity conductor; and a second hole being formed in the intersection of the two dielectric resonator elements of the TM dual-mode dielectric resonator element, the first and second holes being formed so that the TM 110-mode resonance frequency of the TM dual-mode dielectric resonator element is substantially equal to the TM 111-mode resonance frequency.

In the present invention, the hole(s) is (are) formed in a proper form and at a proper location in the TM dual-mode dielectric resonator element so that the TM dual-mode dielectric resonator has the same resonance frequency for both TM 110 and TM 111-modes thereby achieving high performance similar to that of a conventional TM three-mode dielectric resonator without having to increase the overall size.

In the present invention, if the shape and/or the location of the hole or holes formed in the TM dual-mode resonator element are changed, the capacitance of the TM dual-mode resonator element changes and thus the resonance frequency associated with each TM mode also changes. As will be described in greater detail later, the change in resonance frequency associated with TM 110-mode occurs at a different fashion from that of TM 111-mode, and it is possible to obtain the same resonance frequency for both TM 110 and TM 111-modes by properly selecting the shape and/or the location of the hole.

DESCRIPTION OF THE PREFERRED EMBODIMENTS

Figure 1:
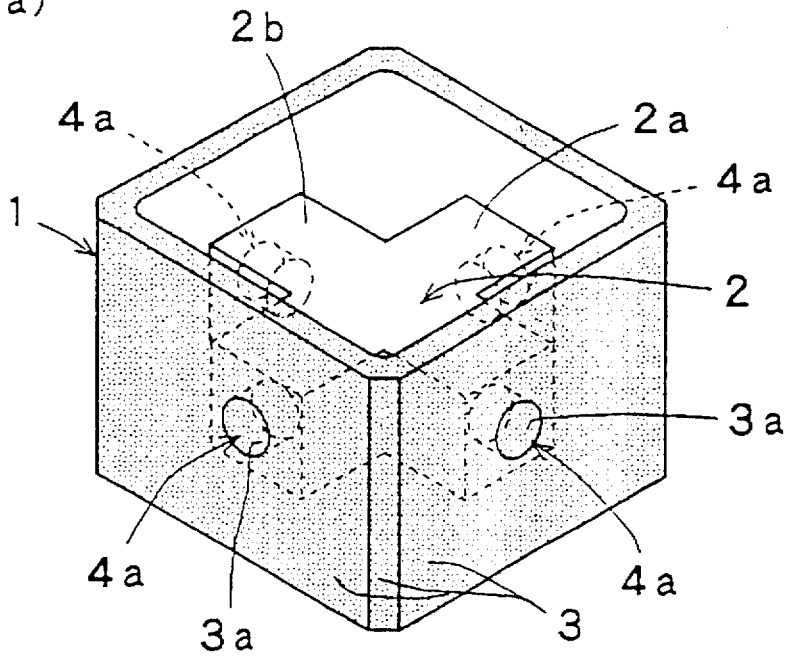
FIG. 1(*a*) is a perspective view illustrating the external appearance of a first embodiment of a dielectric resonator according to the invention, and FIG. 1(*b*) is a side view thereof.
Figure 1:
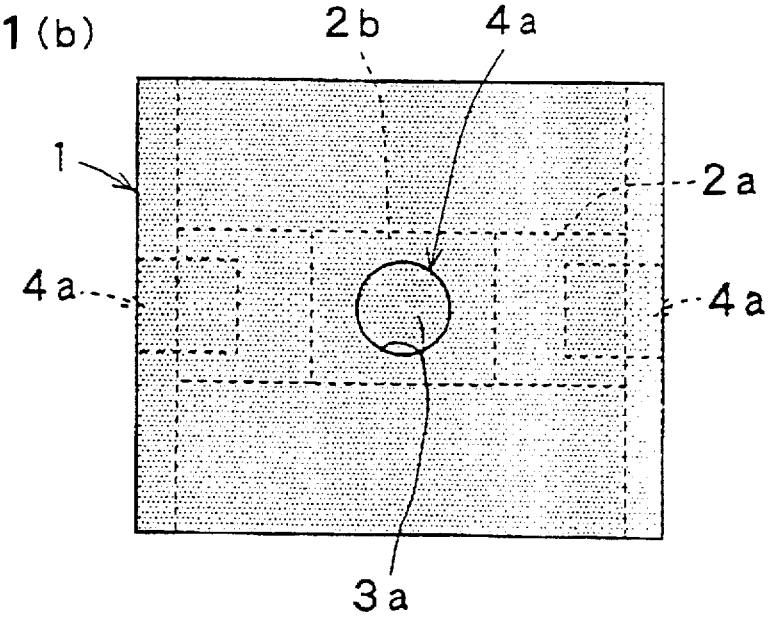

The invention will be described in further detail below with reference to preferred embodiments in conjunction with the accompanying drawings. In the figures, similar parts to those of the figure representing the conventional resonator are denoted by similar reference numerals.

FIG. 1 illustrates the structure of a first embodiment of a dielectric resonator according to the present invention wherein FIG. 1(*a*) is a perspective view illustrating the external appearance and FIG. 1(*b*) is a side view of the dielectric resonator shown in FIG. 1(*a*).

As shown in FIGS. 1(*a*) and 1(*b*), the dielectric resonator of this embodiment includes a cross-shaped TM dual-mode dielectric resonator element 2 disposed in an integral form in a cavity 1. The TM dual-mode dielectric resonator element 2 is composed of resonator elements 2*a* and 2*b*, both ends of each of which are connected to the wall of the cavity 1. A hole 4*a* with a closed end is formed in a central part of each connecting portion between each resonator element 2*a*, 2*b* and the cavity wall in such a manner that each hole 4*a* extends from the outer surface of the cavity wall toward the inner portion of each resonator element 2*a*, 2*b*. The inner wall of each hole 4*a* is covered with a conductor 3*a* which is electrically connected to the cavity conductor 3. In the present embodiment, as described above, holes 4*a* are formed along the axes of the respective resonator elements 2*a* and 2*b* and the cavity conductor 3 also extends over the inner surface of each hole 4*a*. The conductor 3*a* is thus a part of the cavity conductor 3.

The geometric structure, that is, the diameter and the depth of each hole 4*a* are selected so that the TM dual-mode dielectric resonator element 2 has the same resonance frequency for both TM 110 and TM 111-modes. The other parts except for the holes 4*a* are constructed in the same manner as in the conventional resonator shown in FIG. 6 and thus they are not described in further detail here.

Figure 2:
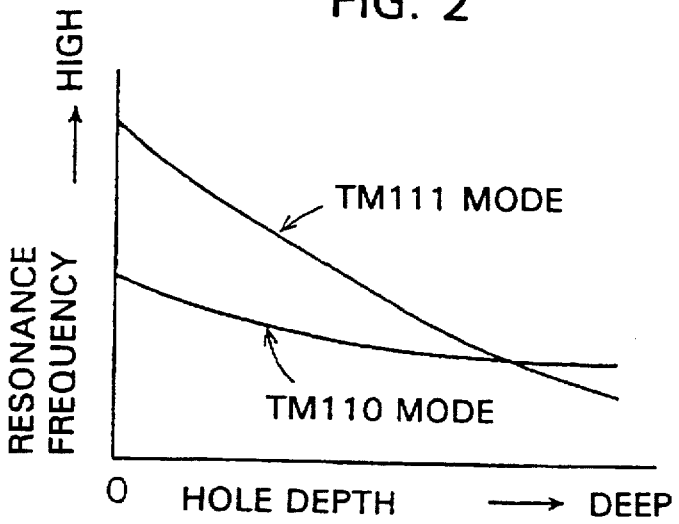
FIG. 2 illustrates the relation between the depth of a hole formed in the dielectric resonator shown in FIG. 1 and its TM 110-mode and TM 111-mode resonance frequencies.

FIG. 2 illustrates the changes in resonance frequencies in TM 110 and TM 111-modes as a function of the depth of the hole 4*a* formed in accordance with the present embodiment.

In the present embodiment, with the increase in the depth of the hole 4*a*, the distance between the opposite ends of the dielectric resonator element 2 decreases and thus the capacitance of the dielectric resonator element 2 increases. With the increase in the capacitance, the resonance frequency decreases in both TM 110 and TM 111-modes as shown in FIG. 2. Although the TM 111-mode has a higher resonance frequency than the TM 110-mode in a shallow depth range, the TM 111-mode resonance frequency decreases at a greater rate with the increase in the depth of the hole 4*a* than the TM 110-mode resonance frequency. Therefore, the TM 111-mode resonance frequency becomes the same as the TM 110-mode resonance frequency at a certain depth.

According to the present embodiment, as can be understood from the above discussion, it is possible to set the TM 110-mode and TM 111-mode resonance frequencies so that they have the same value by properly selecting the diameters and the depths of the holes 4*a*.

Figure 3A:
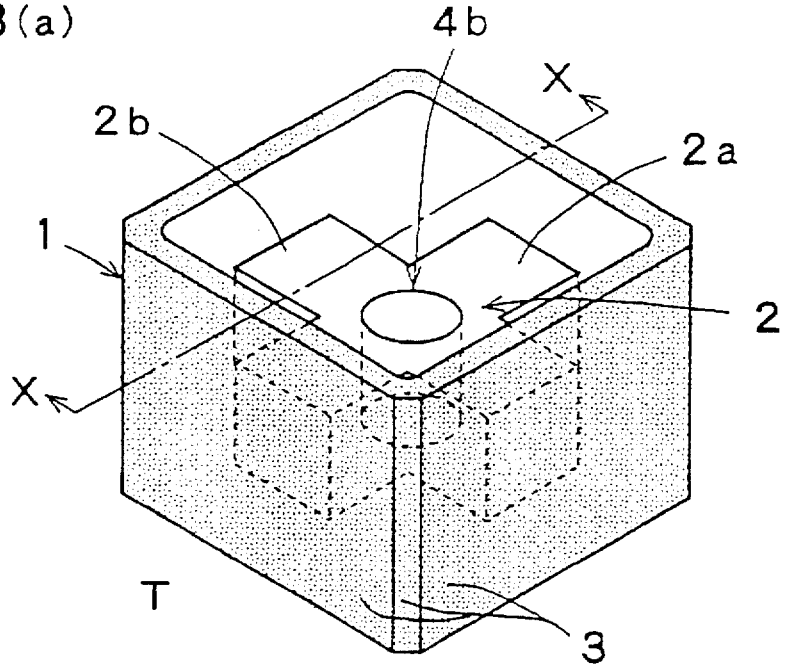
FIG. 3(*a*) is a perspective view illustrating the external appearance of a second embodiment of a dielectric resonator according to the invention, and FIG. 3(*b*) is a cross-sectional view thereof taken along line X—X.
Figure 3B:
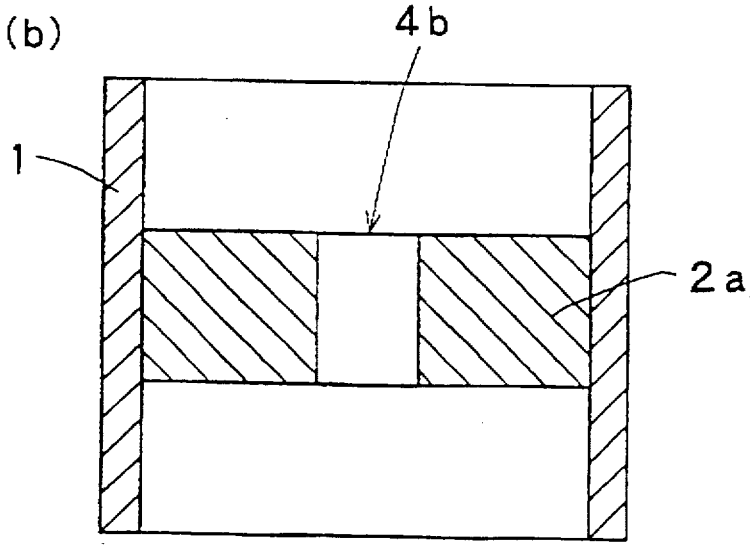

FIG. 3 illustrates the structure of a second embodiment of a dielectric resonator according to the present invention wherein FIG. 3(*a*) is a perspective view illustrating its external appearance and FIG. 3(*b*) is a cross-sectional view of the dielectric resonator shown in FIG. 3(*a*) taken along line X—X.

In the dielectric resonator according to the embodiment shown in FIGS. 3(*a*) and 3(*b*), a hole 4*b* having a circular shape in cross section is formed in a central portion of a dielectric resonator element 2 at which two resonator elements 2*a* and 2*b* cross each other. The hole 4*b* extends through the dielectric resonator element 2 in a direction (in a vertical direction in FIG. 2) across its thickness from one side to the opposite side.

The diameter of the hole 4*b* is selected so that the TM dual-mode dielectric resonator element 2 has the same resonance frequency for both TM 110 and TM 111-modes. The other parts except the hole 4*b* are constructed in the same manner as in the conventional dielectric resonator shown in FIG. 6 and they are not described in further detail here.

Figure 4:
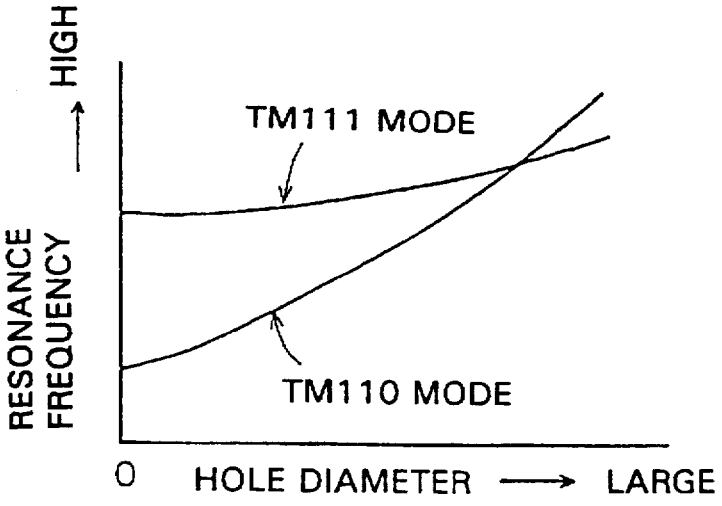
FIG. 4 illustrates the relation between the diameter of a hole formed in the dielectric resonator shown in FIG. 3 and its TM 110-mode and TM 111-mode resonance frequencies.

FIG. 4 illustrates the changes in resonance frequencies in TM 110 and TM 111-modes as a function of the diameter of the hole 4*b* formed in accordance with the present embodiment.

In this second embodiment, the capacitance of the dielectric resonator element 2 decreases with the increase in the diameter of the hole 4*b*. With the decrease in the capacitance, both the TM 110-mode and TM 111-mode resonance frequencies increase as shown in FIG. 4. Although the TM 110-mode has a lower resonance frequency than the TM 111-mode in a small-diameter range, the TM 110-mode resonance frequency increases at a greater rate with the increase in the diameter of the hole 4*b* than the TM 111-mode resonance frequency. Therefore, the TM 110-mode resonance frequency is the same as the TM 111-mode resonance frequency at a certain diameter.

According to this embodiment, as can be understood from the above discussion, it is possible to set the TM 110-mode and TM 111-mode resonance frequencies so that they have the same value by properly selecting the diameter of the hole 4*b*. Although in the specific example described above the hole is formed through the dielectric resonator element such that it extends from one side to the opposite side of the resonator element, the hole may also be formed in such a manner that it has a closed end.

Figure 5:
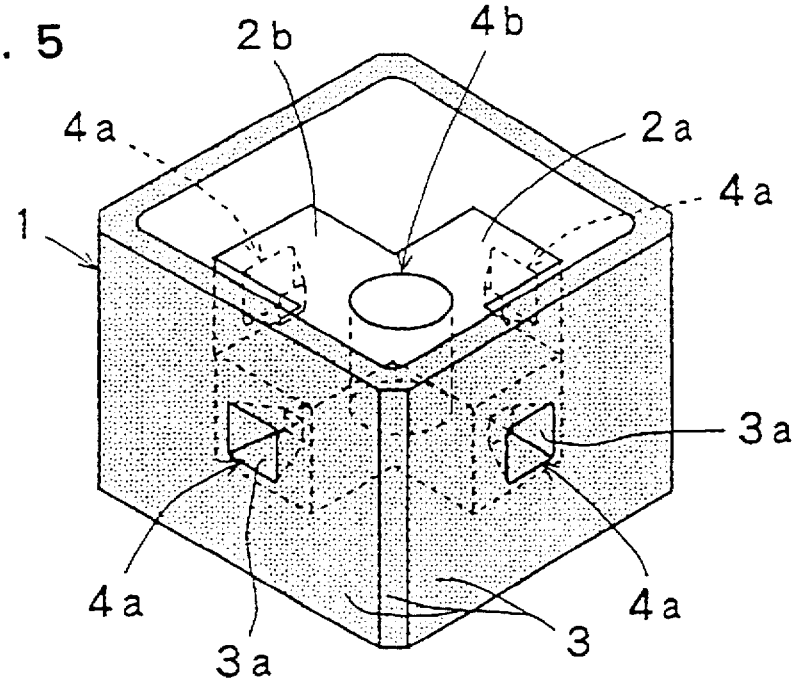
FIG. 5 is a perspective view illustrating the external appearance of a third embodiment of a dielectric resonator according to the invention.

FIG. 5 is a perspective view illustrating the structure of a third embodiment of a dielectric resonator according to the present invention.

In the dielectric resonator according to the embodiment shown in FIG. 5, a hole 4*b* having a circular shape in cross section is formed in the intersection of two resonator elements 2*a* and 2*b* wherein the hole 4*b* extends through the dielectric resonator element 2 in a direction across its thickness. Furthermore, a hole 4a, for example, a quadrangular pyramid-shaped hole 4a having a closed end, is formed in each connecting part between each resonator element 2a, 2b and a cavity wall 1 in such a manner that each hole 4a extends from the outer surface of the cavity wall toward the inner portion of each resonator element 2a, 2b. The inner wall of each hole 4a is covered with a conductor 3a which is electrically connected to the cavity conductor 3.

The shape of the holes 4a and 4b are determined so that the TM dual-mode dielectric resonator element 2 has the same resonance frequency for both TM 110 and TM 111-modes.

Figure 6:
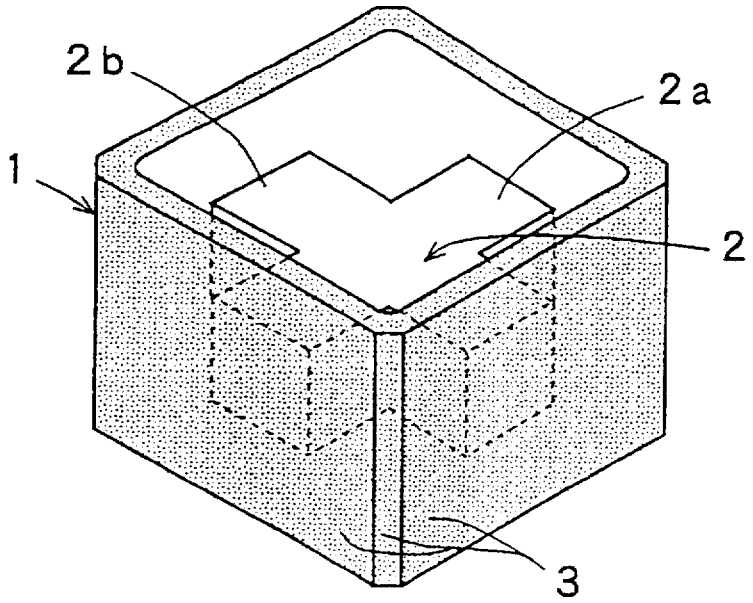
FIG. 6 PRIOR ART
FIG. 6 is a perspective view illustrating the external appearance of a conventional dielectric resonator.

The other parts except for the holes 4a and 4b are constructed in the same manner as in the conventional resonator shown in FIG. 6 and thus they are not described in further detail here. The dielectric resonator of the embodiment of FIG. 5, as described above, has a structure obtained by combining the structures of the first and second embodiments. This structure allows the capacitance of the dielectric resonator element 2 to be set in a more flexible manner than in the previous embodiments.

In this embodiment, it is possible to set the TM 110-mode and TM 111-mode resonance frequencies so that they have the same value by properly selecting the inner diameters, the locations, and the depths of the holes 4a formed along the axes of the dielectric resonator element 2 and of the hole 4b formed across its thickness.

In each embodiment described above, the holes 4a and 4b may be formed simultaneously in the process in which the dielectric resonator is formed, or may be formed by cutting or the like after forming the dielectric resonator.

Although in the specific embodiments described above, the dielectric resonator element 2 is formed in an integral fashion in the cavity, the dielectric resonator element and the cavity may also be formed separately and then combined into a single piece with a silver-filled adhesive or the like.

Furthermore, the cavity itself may also be formed by combining six separately-formed ceramic plates coated with a conductor into a single piece with a silver-filled adhesive or the like. A metal case may also be employed to form the cavity.

In the dielectric resonator according to the above embodiments of the invention, the hole(s) is (are) formed in a proper shape and at a proper location in the TM dual-mode resonator element so that the TM 110-mode resonance frequency of the TM dual-mode resonator element is equal to the TM 111-mode resonance frequency. This makes it possible to easily achieve high performance similar to that of a conventional TM three-mode dielectric resonator.

Thus it is possible to produce a small-sized high-performance dielectric filter using a dielectric resonator according to the present invention.

Figure 7:
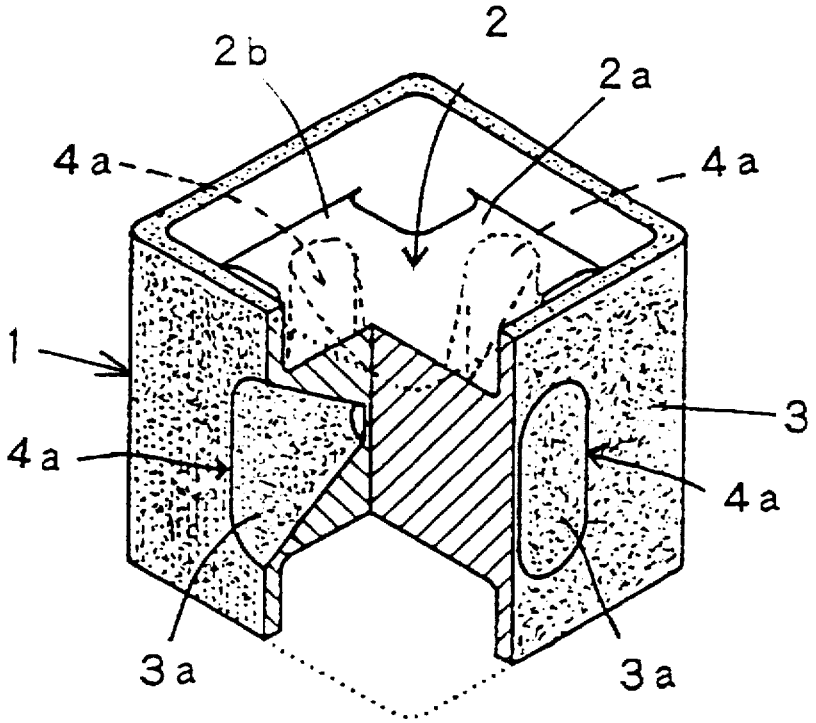
FIG. 7 is a partially cutaway perspective view of a dielectric resonator which is a variation of the third embodiment of the invention.

FIG. 7 illustrates the structure of a dielectric resonator which is a variation of the third embodiment of the invention. In FIG. 7, a part of the dielectric resonator is cut away so as to show the internal structure of a hole.

In the dielectric resonator of the embodiment shown in FIG. 7, an elliptic cone-shaped hole 4a is formed in each connecting part between each end of two resonator elements 2a and 2b and a cavity wall 1 in such a manner that each hole 4a extends from the outer surface of the cavity wall 1 toward the inner portion of each resonator element 2a, 2b. The inner wall of each hole 4a is covered with a conductor 3a electrically connected to a cavity conductor 3.

The shape of each hole 4a is determined so that the TM 110-mode resonance frequency of the TM dual-mode dielectric resonator element 2 is equal to the TM 111-mode resonance frequency.

The other parts except for the holes 4a are constructed in the same manner as in the conventional resonator shown in FIG. 6 and thus they are not described in further detail here. The dielectric resonator of the present embodiment is different from the third embodiment described above in that the holes 4a are formed in a different shape.

In the embodiment of FIG. 7, it is possible to set the TM 110-mode and TM 111-mode resonance frequencies so that they have the same value by properly selecting the inner diameters, the locations, and the depths of the holes 4a formed from the cavity wall into the dielectric resonator element 2 in directions perpendicular to the corresponding cavity wall, and also by properly selecting the size of the rectangular-shaped resonator and the relative dielectric constant $\epsilon_r$ of the dielectric material.

Preferably the resonance frequencies in both modes are set in the range of 800–1000 MHz.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A dielectric resonator including two dielectric resonator elements arranged perpendicular to each other and disposed in a cavity so as to form a TM dual-mode dielectric resonator element, the TM dual-mode dielectric resonator element having a TM 110-mode resonance frequency and a TM 111-mode resonance frequency, said dielectric resonator having:

at least one hole formed in said TM dual-mode dielectric resonator element, said hole extending from an outer surface of a wall of the cavity toward an inner portion of said TM dual-mode dielectric resonator element along an axis of a corresponding one of the resonator elements, the hole having an inner wall, the cavity having a conductor disposed on walls of the cavity, the inner wall of said hole being covered with a conductor electrically connected to the cavity conductor, and said hole being formed so that the TM 110-mode resonance frequency of said TM dual-mode dielectric resonator element is substantially equal to the TM 111-mode resonance frequency.

2. The dielectric resonator of claim 1, wherein:

said cavity is defined by a substantially rectangular structure which houses said dielectric resonator elements, each said dielectric resonator element contacting an inner wall of the cavity at opposite first and second ends of said dielectric resonator element, said at least one hole comprising a plurality of holes such that each respective hole extends from an outer wall of the cavity and toward a corresponding one of the first and second ends.

3. The dielectric resonator of claim 1, wherein the depth of said at least one hole is selected so that the TM 110 resonance frequency and the TM 111 resonance frequency are substantially the same.

4. The dielectric resonator of claim 2, wherein the depths of the plurality of holes are selected so that the TM 110 resonance frequency and TM 111 resonance frequency are substantially the same.

5. The dielectric resonator of claim 1, wherein the two dielectric resonator elements are disposed in the cavity and are integral therewith.

6. The dielectric resonator of claim 1, wherein the cavity comprises an integral member.

7. The dielectric resonator of claim 1, wherein the cavity comprises a plurality of separate pieces joined together into a unitary structure.

8. The dielectric resonator of claim 1, wherein the TM 110 and TM 111 resonance frequencies are capable of being decreased, by increasing the depth of said at least one hole.

9. A dielectric resonator including two dielectric resonator elements arranged perpendicular to each other and having an intersection portion where the two elements intersect and further being disposed in a cavity so as to form a TM dual-mode dielectric resonator element, the TM dual-mode dielectric resonator element having a TM 110-mode resonance frequency and a TM 111-mode resonance frequency, said dielectric resonator having a hole formed at the intersection portion of said two dielectric resonator elements, said hole being formed so that the TM 110-mode resonance frequency of said TM dual-mode dielectric resonator element is substantially equal to the TM 111-mode resonance frequency.

10. The dielectric resonator of claim 9, wherein said cavity is defined by a substantially rectangular structure which houses said dielectric resonator elements, each said dielectric resonator element contacting a wall of the cavity at first and second opposite ends of said dielectric resonator element.

11. The dielectric resonator of claim 9, wherein the diameter of the hole is selected so that the TM 110 resonance frequency and TM 111 resonance frequency are substantially the same.

12. The dielectric resonator of claim 9, wherein the two dielectric resonator elements are disposed in the cavity and are integral therewith.

13. The dielectric resonator of claim 9, wherein the cavity comprises an integral member.

14. The dielectric resonator of claim 9, wherein the cavity comprises a plurality of separate pieces joined together into a unitary structure.

15. The dielectric resonator of claim 9, wherein the TM 110 and TM 111 resonance frequencies are capable of being increased, by increasing the diameter of said hole.

16. The dielectric resonator of claim 9, wherein said hole extends completely through the intersection portion of said dielectric resonator elements.

17. A dielectric resonator including two dielectric resonator elements arranged perpendicular to each other and having an intersection portion where the two elements intersect and further being disposed in a cavity so as to form a TM dual-mode dielectric resonator element, the TM dual-mode dielectric resonator element having a TM 110-mode resonance frequency and a TM 111-mode resonance frequency, said dielectric resonator having:

at least one first hole formed in said TM dual-mode dielectric resonator element, said first hole extending from an outer surface of a wall of the cavity toward an inner portion of said TM dual-mode dielectric resonator element along an axis of a corresponding one of the resonator elements, the first hole having an inner wall, the cavity having a conductor disposed on walls of the cavity, the inner wall of said first hole being covered with a conductor electrically connected to the cavity conductor; and said dielectric resonator further having a second hole formed at the intersection portion of said two dielectric resonator elements, said first and second holes being formed so that the TM 110-mode resonance frequency of said TM dual-mode dielectric resonator element is substantially equal to the TM-111 mode resonance frequency.

18. The dielectric resonator of claim 1, wherein the frequency at which the TM dual-mode dielectric resonator element resonates in both TM 110 and TM 111-modes is selected within the range from 800 to 1000 MHz.

19. The dielectric resonator of claim 18, wherein said at least one hole whose inner wall is covered with the conductor electrically connected to said cavity conductor is formed in the shape of an elliptic cone.

20. The dielectric resonator of claim 9, wherein the frequency at which the TM dual-mode dielectric resonator element resonates in both TM 110 and TM 111-modes is selected within the range from 800 to 1000 MHz.

21. The dielectric resonator of claim 17, wherein the frequency at which the TM dual-mode dielectric resonator element resonates in both TM 110 and TM 111-modes is selected within the range from 800 to 1000 MHz.

22. The dielectric resonator of claim 19, wherein:

said cavity is defined by a substantially rectangular structure which houses said dielectric resonator elements, each said dielectric resonator element contacting an inner wall of the cavity at first and second opposite ends of said dielectric resonator element, said at least one first hole comprising a plurality of holes such that each respective hole extends from an outer wall of the cavity and toward a corresponding one of the first and second ends.

23. The dielectric resonator of claim 17, wherein the depth of said at least one first hole is selected so that the TM 110 resonance frequency and TM 111 resonance frequency are substantially the same.

24. The dielectric resonator of claim 22, wherein the depths of the holes are selected so that the TM 110 resonance frequency and TM 111 resonance frequency are substantially the same.

25. The dielectric resonator of claim 17, wherein the two dielectric resonator elements are disposed in the cavity integral therewith.

26. The dielectric resonator of claim 17, wherein the cavity and are comprises an integral member.

27. The dielectric resonator of claim 17, wherein the cavity comprises a plurality of separate pieces joined together into a unitary structure.

28. The dielectric resonator of claim 17, wherein the diameter of the second hole is selected so that the TM 110 resonance frequency and TM 111 resonance frequency are substantially the same.

29. The dielectric resonator of claim 17, wherein said at least one first hole is tapered so as to decrease in cross section as it extends toward said corresponding dielectric resonator element.

30. The dielectric resonator of claim 29, wherein said at least one first hole is cone shaped.

31. The dielectric resonator of claim 29, wherein said at least one first hole is pyramid shaped.

32. The dielectric resonator of claim 17, wherein the TM 110 and TM 111 resonance frequencies are capable of being decreased, by increasing the depth of said at least one first hole, and are capable of being increased by increasing the diameter of the second hole.

33. A method of adjusting the resonance frequency of a dielectric resonator comprising two dielectric resonator elements arranged perpendicular to each other and disposed in a cavity so as to form a TM dual mode dielectric resonator element, the method comprising the step of:

forming at least one hole in said TM dual mode dielectric resonator element so that the hole extends from an outer surface of a wall of the cavity toward an inner portion of said TM dual mode dielectric resonator element along an axis of a corresponding resonator element, the hole having an inner wall, the cavity having a conductor disposed on walls of the cavity, the inner wall of the hole being covered with a conductor electrically connected to the cavity conductor;

wherein said dielectric resonator element has a TM 110-mode resonance frequency and a TM 111-mode resonance frequency, and further comprising the step of forming the at least one hole so that the TM 110-mode resonance frequency of said TM dual mode dielectric resonator element is substantially equal to the TM 111-mode resonance frequency.

34. The method of claim 33, further comprising the step of selecting the depth of the at least one hole so that the TM 110-mode resonance frequency and TM 111-mode resonance frequency are substantially the same.

35. The method of claim 33, wherein said cavity comprises a substantially rectangular structure which houses said dielectric resonator elements, each said dielectric resonator element contacting an inner wall of the cavity at first and second opposite ends of said dielectric resonator element, and further comprising the step of providing a plurality of said holes including said at least one hole, each of said plurality of holes extending from an outer wall of the cavity toward a respective one of the first and second ends.

36. The method of claim 35, further comprising the step of selecting depths of the plurality of holes so that the TM 110 resonance frequency and TM 111 resonance frequency are substantially the same.

37. The method of claim 34, further comprising the step of selecting the depth of the at least one hole whereby as the depth is increased, the TM 110 and TM 111-mode resonance frequencies decrease.

38. A method of adjusting the resonance frequency of a dielectric resonator including two dielectric resonator elements arranged perpendicular to each other and having an intersection portion where the elements intersect and further being disposed in a cavity so as to form a TM dual mode dielectric resonator element, the method comprising the step of:

forming a hole at the intersection portion of said two dielectric resonator elements of said TM dual mode dielectric resonator element:

wherein the dielectric resonator element has a TM 110-mode resonance frequency and a TM 111-mode resonance frequency, and further comprising the step of forming the hole so that the TM 110-mode resonance frequency and said TM 111-mode resonance frequency are substantially the same.

39. The method of claim 38, further comprising the step of selecting the diameter of the hole so that the TM 110 resonance frequency and TM 111 resonance frequency are substantially the same.

40. The method of claim 39, further comprising the step of selecting the diameter of the hole whereby as the diameter is increased, the TM 110 and TM 111-mode resonance frequencies increase.

41. A method of adjusting the resonance frequency of a dielectric resonator including two dielectric resonator elements arranged perpendicular to each other and having an intersection portion where the elements intersect and further being disposed in a cavity so as to form a TM dual mode dielectric resonator element, the method comprising the steps of forming at least one first hole in said TM dual mode dielectric resonator element extending from an outer surface of a wall of the cavity toward an inner portion of said TM dual-mode dielectric resonator element along an axis of a corresponding resonator element, the first hole having an inner wall, the cavity having a conductor disposed on walls of the cavity, the inner wall of the first hole being covered with a conductor electrically connected to the cavity conductor, and forming a second hole at the intersection portion of said two dielectric resonator elements;

wherein the dielectric resonator element has a TM 110-mode resonance frequency and TM 111-mode resonance frequency and further comprising the step of forming said first and second holes so that the TM 110-mode resonance frequency and said TM 111-mode resonance frequency are substantially the same.

42. The method-of claim 41, further comprising the step of selecting a depth of the at least one first hole and a diameter of the second hole so that the TM 110 resonance frequency and TM 111 resonance frequency are substantially the same.

43. The method of claim 41, wherein the cavity is defined by a substantially rectangular structure which houses said dielectric resonator elements, each said dielectric resonator element contacting an inner wall of the cavity at first and second opposite ends of said dielectric resonator element, an-further comprising the steps of:

providing a plurality of first holes including said at least one first hole, each said first hole extending from an outer wall of the cavity toward a respective one of the first and second ends; and selecting depths of said holes of said plurality of first holes and a diameter of said second hole so that the TM 110 resonance frequency and TM 111 resonance frequency are substantially the same.

44. The method of claim 42, wherein the TM 110 and TM 111-mode resonance frequencies decrease as the depth of the at least one first hole increases, and increase as the diameter of the second hole increases.

45. The method of claim 43, wherein the TM 110 and TM 111-mode resonance frequencies decrease as the depths of the plurality of first holes increase, and increase as the diameter of the second hole increases.

* * * * *